United States Patent [19]

Goloff

[11] 4,067,669

[45] Jan. 10, 1978

[54] ROTARY MECHANISM WITH AGITATORS IN THE ROTOR COOLANT CAVITIES

[75] Inventor: Alexander Goloff, East Peoria, Ill.

[73] Assignee: Caterpillar Tractor Co., Peoria, Ill.

[21] Appl. No.: 702,169

[22] Filed: July 2, 1976

[51] Int. Cl.[2] ..... F01C 1/02; F01C 21/06; B01F 15/06

[52] U.S. Cl. ..... 418/53; 418/91; 366/135

[58] Field of Search ..... 418/49-53, 418/91, 94; 123/8.01; 308/119; 259/3

[56] References Cited

U.S. PATENT DOCUMENTS

| | | | |
|---|---|---|---|
| 1,329,499 | 2/1920 | Binkley | 308/119 |
| 3,102,683 | 9/1963 | Paschke et al. | 418/94 |
| 3,234,921 | 2/1966 | Laing et al. | 418/91 |
| 3,302,624 | 2/1967 | Tatsutomi | 418/91 |
| 3,492,974 | 2/1970 | Kreimeyer | 418/53 |

FOREIGN PATENT DOCUMENTS

| | | | |
|---|---|---|---|
| 1,451,756 | 7/1969 | Germany | 418/88 |

*Primary Examiner*—John J. Vrablik

*Attorney, Agent, or Firm*—Wegner, Stellman, McCord, Wiles & Wood

[57] ABSTRACT

A rotary mechanism including a housing defining a chamber, a shaft journalled in the housing to extend through the chamber and having an eccentric within the chamber, a rotor within the chamber and journalled on the eccentric, the rotor having surfaces cooperating with the housing to vary the volume of at least one portion of the chamber upon rotation of the shaft, the rotor and the housing relative to each other, coolant receiving cavities in the rotor adjacent the surfaces, a source of coolant for the cavities, and agitators within the cavities and movable therein for cyclically displacing the coolant to enhance heat transfer.

10 Claims, 2 Drawing Figures

ROTARY MECHANISM WITH AGITATORS IN THE ROTOR COOLANT CAVITIES

BACKGROUND OF THE INVENTION

This invention relates to rotary mechanisms such as rotary engines, pumps, expanders, compressors, or the like. More specifically, the invention relates to improved cooling of the rotor employed in such mechanisms.

Cooling the periphery of a rotor in a rotary mechanism by means of oil within the rotor is difficult because centrifugal force, during operation of the rotary mechanism having the rotor, causes the oil to move and remain radially outwardly within coolant cavities. Significant movement of the oil occurs only at its free surface within the coolant cavity, there being very little agitation of the coolant at radially outer peripheral portions of the cavity. As a result, the efficiency of heat transfer from the rotor to the coolant is low.

As a consequence, the surfaces of the rotor may run at a higher temperature than desired. Such high temperatures are not conducive to the maintenance of oil films necessary to ensure long life of seals carried by the rotor. Thus, the useful life of the mechanism is decreased and periodic maintenance is required at more frequent intervals than is desired.

SUMMARY OF THE INVENTION

It is the principal object of the invention to provide a new and improved rotary mechanism. More specifically, it is an object of the invention to provide a rotary mechanism including improved means for cooling the rotor.

An exemplary embodiment of the invention achieves the foregoing objects in a rotary mechanism including a housing defining a chamber. A shaft is journalled in the housing to extend through the chamber and has an eccentric within the chamber. A rotor is disposed within the chamber and journalled on the eccentric. The rotor has surfaces cooperating with the housing to vary the volume of at least one portion of the chamber upon rotation of the shaft, the rotor and the housing relative to each other. The rotor is provided with coolant receiving cavities adjacent the surfaces and means are provided for directing a coolant to the cavities. Agitators are disposed within the cavities and are movable therein for cyclically displacing the coolant to enhance heat transfer.

In a highly preferred embodiment, the agitators are formed of a material having a greater density than that of the coolant.

In one embodiment, the rotary mechanism is a slant axis rotary mechanism and the eccentric is angularly offset on the shaft. The cavities are located in the peripheral flange customarily employed on the rotor of such mechanisms.

The invention contemplates that the agitators comprise bodies having exterior shapes conforming to the interior shape of the cavities in which they are received so as to minimize or eliminate point or line contact of the agitators with the cavity walls which could cause weakening of such walls over a long period of time.

In a preferred embodiment, the agitator bodies are perforated to allow flow of the coolant therethrough to generate turbulence and thereby increase the coefficient of heat transfer.

When the invention is employed in a slant axis rotary mechanism, it is highly preferred that the agitator bodies be U-shaped. The legs of the U-shaped agitator bodies have exterior surfaces generally parallel to the adjacent cavity side walls. The cavities preferably have extensions within the hub of the rotor of the slant axis rotary mechanism extending to both sides of the peripheral flange and each of the legs of the U-shaped agitator bodies includes a projection to the side thereof extending into a corresponding one of the extensions. A piloting surface is located on each side of the cavity at the juncture of the side walls and the extensions.

If desired, the agitator bodies may be coated with a layer of an elastomer.

Other objects and advantages will become apparent from the following specification taken in connection with the accompanying drawings.

DESCRIPTION OF THE PREFERRED EMBODIMENT

Figure 1:
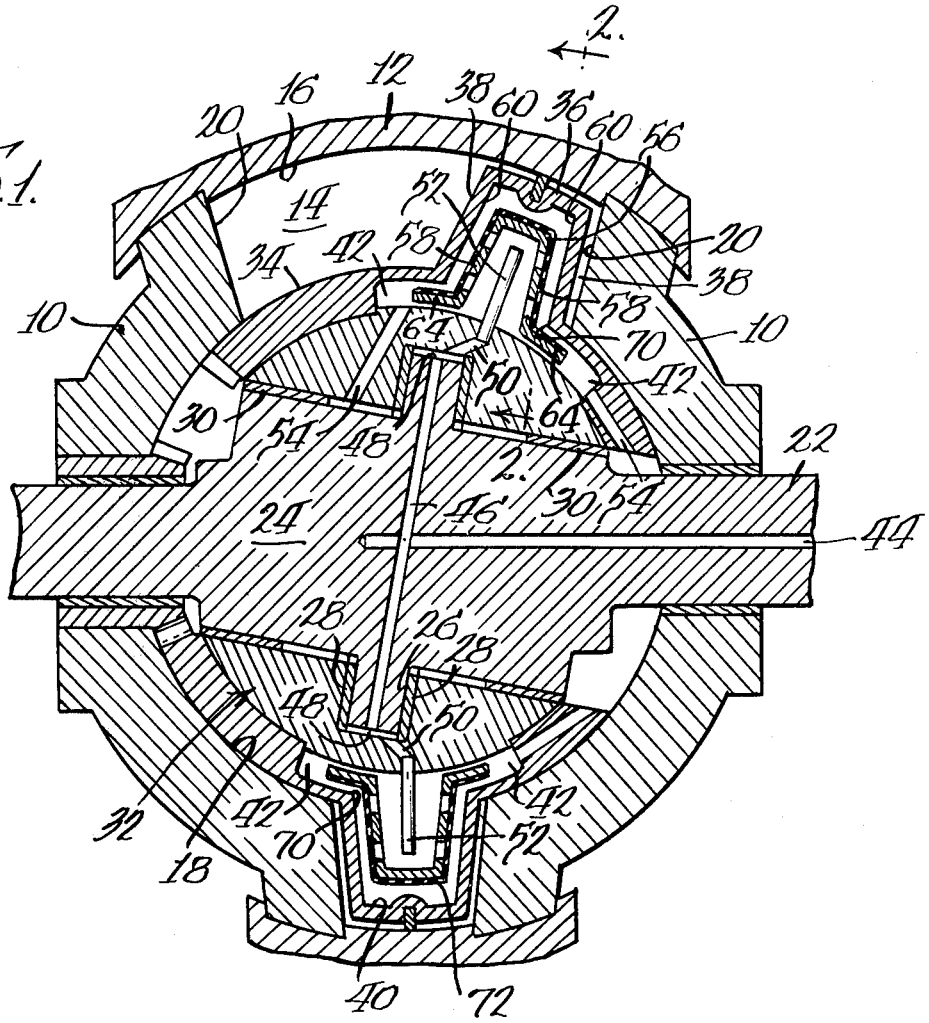
FIG. 1 is a sectional view of a rotary mechanism, specifically, a slant axis rotary mechanism, made according to the invention.

An exemplary embodiment of the invention is illustrated in the Figures in the form of a four-cycle, slant axis rotary engine. However, it is to be understood that the principles of the invention may be employed in rotary mechanisms of other types as, for example, trochoidal mechanisms, and rotary mechanisms used other than as engines, as, for example, compressors, pumps, expanders, or the like. It is also to be understood that the invention can be advantageously employed in mechanisms operating on other than four-cycle principles.

A slant axis rotary mechanism made according to the invention is seen to include opposed end housings 10 and a central housing 12 which define a chamber 14. The center housing 12 defines a radially outer spherical wall 16 while the end housings 10 define a radially inner spherical wall 18. Each of the end housings 10 includes a generally radially extending end wall 20 interconnecting the radially inner and outer spherical walls 16 and 18.

A shaft 22 is journalled in the end housing 10 by means of suitable bearings to extend through the chamber 14. Within the chamber 14, the shaft 22 has an eccentric 24 which, in the case of a slant axis rotary mechanism, is angularly offset. A thrust collar 26 is disposed on the eccentric 24 and is flanked by thrust bearings 28. Journal bearings 30 are also carried by the eccentric 24.

Journalled on the eccentric 24 is a rotor, generally designated 32, having a generally spherical hub 34 and a peripheral, radially outwardly extending flange 36. The sides 38 of the flange, for a four-cycle mechanism, are each configured to have three apexes, the apexes on one side 38 being staggered with respect to the apexes on the opposite side. Thus, the sides 38, as is well known, cooperate with the radially outer spherical wall 16 and the end wall 20 to cyclically vary the volume of portions of the chamber upon rotation of the shaft 22, the rotor 30, and the housing with respect to each other.

Figure 2:
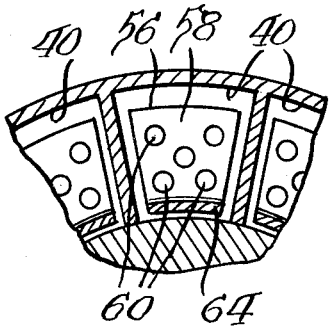
FIG. 2 is a sectional view taken approximately along the line 2—2 of FIG. 1.

Interiorly of the flange 36 and about the periphery thereof, as best seen in FIG. 2, there are a series of coolant receiving cavities 40. As best seen in FIG. 1, the cavities extend somewhat into the hub 34 of the rotor 32 and have extensions 42 to each side of the flange 36.

The shaft 22 includes a central bore 44 connected to a source of lubricant and coolant, typically an oil pump, whereby the coolant and lubricant may be delivered to a cross conduit 46 opening in ports 48 on the radially outer periphery of the thrust collar 26. Thus, the coolant and lubricant is delivered to the area adjacent the interface of the thrust collar 26 and the thrust bearings 28 to lubricate the same.

Additionally, the rotor hub 34, for each of the cavities 40, is provided with a bore 50 opening to the radially outer periphery of the thrust collar 26. The bores 50 are connected to pipe-like conduits or nozzles 52 within each of the cavities 40. As a consequence, lubricant and coolant will be directed through the conduits 50 and the nozzles 52 into each of the cavities 40.

To drain coolant from the cavities 40, each extension 42 for each cavity is provided with a bore 54 extending to the interface of the rotor hub 34 and the shaft 22 or the eccentric 24.

Within each cavity 40 is an agitator body 56. The agitator body 56 is made as light as possible and of a material having a density greater than that of the coolant, usually oil. Each agitator body 56 is U-shaped and the legs 58 thereof have exterior surfaces that are generally parallel to the adjacent interior side wall surface 60 of the cavity 40 in which they are received. The legs 58 are also provided with perforations 60 as best seen in FIG. 2.

The ends of the legs 58 remote from the bight of the U-shaped body 56 have projections 64 thereon which extend into corresponding ones of the extensions 42 of the cavity 40. The bodies 56 are dimensioned so that if one leg 58 is in substantial abutment with a side wall 60 of a cavity 40, projections 64 on the opposite leg will not leave the extension 42 of the cavity in which it is received. As a consequence, radially outward movement of the agitator bodies 56 within the cavities 40 is restricted while the projections 64 cooperate with the cavity extensions 42 to provide a piloting action for the agitators 56.

Those skilled in the art will recognize that during operation of a slant axis rotary mechanism, the rotor flange will move from side to side or wobble. Such wobbling causes the agitator bodies 56 to cyclically move from one side of the cavity 40 in which they are received to the other to displace the coolant and cause turbulence therein to enhance heat transfer. To ensure relatively free movement of the agitator bodies 56, the juncture of each side wall 60 of the cavities 40 and the extension 42 is rounded as at 70, the rounded surface minimizing stress generation upon contact of the agitator body 56 with the wall 60.

The structure is completed by providing an optional coating 72 of an elastomer on at least the outer surface of the agitator bodies 56.

It will be observed that the formation of the sides, that is, the legs 58 of the agitator bodies 56 to conform more or less to the internal walls of the cavity results in the creation of a squeeze film between the agitator and the cavity with the result that the oil stops the agitator rather than metal-to-metal contact or metal-to-elastomer contact. Such contact is not desired because it produces wear in the form of local indenting of the metal of which the rotor is formed and fatigue. The presence of the elastomer 72, if used, of course, precludes metal-to-metal contact, but in any event, the shaping of the parts to generate a squeeze film of oil greatly increases life of the assembly.

The rotor can be fabricated according to any conventional technique. In general, the agitators may be placed in the coring used to form the cavities 40 when the rotor is cast.

I claim:

1. In a rotary mechanism, the combination of:
- a housing defining a chamber;
- a shaft journalled in said housing to extend through the chamber and having an eccentric within the chamber;
- a rotor within the chamber and journalled on said eccentric, said rotor having surfaces cooperating with said housing to vary the volume of at least one portion of the chamber upon rotation of said shaft, said rotor and said housing relative to each other;
- coolant receiving cavities in said rotor adjacent said surfaces;
- means for directing coolant to said cavities; and
- agitators loosely disposed within said cavities to be movable with the rotor and to be movable within the cavities for cyclically displacing the coolant to enhance heat transfer.

2. The rotary mechanism of claim 1 wherein said agitators are formed of a material having a greater density than that of the coolant.

3. The rotary mechanism of claim 1 wherein the mechanism is a slant axis rotary mechanism and said eccentric is angularly offset on said shaft, said cavities being located in and said surfaces being located on a peripheral flange on said rotor.

4. The rotary mechanism of claim 1 wherein said agitators are at least partially coated with an elastomer.

5. The rotary mechanism of claim 1 wherein said agitators are bodies having exterior shapes conforming to the interior shape of the cavities in which they are received.

6. The rotary mechanism of claim 5 wherein said bodies are perforated.

7. A slant axis rotary mechanism comprising:
- a housing defining a chamber having radially inner and outer spherical walls interconnected by spaced, generally radially extending, opposed end walls;
- a shaft journalled in said housing and having an angularly offset eccentric within said chamber;
- a rotor having a spherical hub and a radially outwardly extending peripheral flange in said chamber and journalled on said eccentric;
- coolant receiving cavities within said flange;
- means for directing a coolant to said cavities; and
- agitator bodies formed of a material having a higher density than that of the coolant loosely received in said cavities.

8. The slant axis rotary mechanism of claim 7 wherein said cavities have spaced apart side walls and said agitator bodies are U-shaped, the legs of said U-shaped agitator bodies having exterior surfaces generally parallel to the adjacent cavity side wall.

9. The slant axis rotary mechanism of claim 8 wherein said legs are perforated.

10. The slant axis rotary mechanism of claim 8 wherein said cavities have extensions within said hub to both sides of said flange and each of said legs includes a projection from the side thereof extending into a corresponding one of said extensions, and a piloting surface on each side of said cavity at the juncture of the side walls and the extensions.

* * * * *